US009657364B2

(12) United States Patent
Yokoi et al.

(10) Patent No.: US 9,657,364 B2
(45) Date of Patent: May 23, 2017

(54) HIGH STRENGTH HOT ROLLED STEEL SHEET FOR LINE PIPE USE EXCELLENT IN LOW TEMPERATURE TOUGHNESS AND DUCTILE FRACTURE ARREST PERFORMANCE AND METHOD OF PRODUCTION OF SAME

(71) Applicant: Nippon Steel & Sumitomo Metal Corporation, Tokyo (JP)

(72) Inventors: Tatsuo Yokoi, Tokyo (JP); Hiroshi Abe, Tokyo (JP); Osamu Yoshida, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 19 days.

(21) Appl. No.: 14/329,295

(22) Filed: Jul. 11, 2014

(65) Prior Publication Data

US 2014/0318672 A1 Oct. 30, 2014

Related U.S. Application Data

(62) Division of application No. 12/736,903, filed as application No. PCT/JP2009/059922 on May 25, 2009, now abandoned.

(30) Foreign Application Priority Data

May 26, 2008 (JP) ..... 2008-137195
Mar. 26, 2009 (JP) ..... 2009-077146

(51) Int. Cl.
*C21D 8/02* (2006.01)
*C21C 7/00* (2006.01)
(Continued)

(52) U.S. Cl.
CPC ..... *C21D 8/0263* (2013.01); *C21C 7/0006* (2013.01); *C21C 7/06* (2013.01);
(Continued)

(58) Field of Classification Search
CPC ..... C21D 8/0263; C21D 1/18; C21D 1/19; C21D 7/04
See application file for complete search history.

(56) References Cited

U.S. PATENT DOCUMENTS

2002/0162613 A1 11/2002 Kashima et al.
2004/0101432 A1 5/2004 Bai et al.
2007/0144620 A1* 6/2007 Soshiroda et al. ..... 148/320

FOREIGN PATENT DOCUMENTS

EP 1857562 A1 * 11/2007 ..... C21D 8/02
JP 10-158723 6/1998
(Continued)

OTHER PUBLICATIONS

International Search Report dated Aug. 25, 2009 issued in corresponding PCT Application No. PCT/JP2009/059922.
(Continued)

*Primary Examiner* — Rebecca Lee
(74) *Attorney, Agent, or Firm* — Birch, Stewart, Kolasch & Birch, LLP

(57) ABSTRACT

The present invention has as its object the provision of hot rolled steel sheet (hot coil) for line pipe use in which API5L-X80 standard or better high strength and low temperature toughness and ductile fracture arrest performance are achieved and a method of production of the same.
For this purpose, the hot rolled steel sheet of the present invention comprises C, Si, Mn, Al, N, Nb, Ti, Ca, V, Mo, Cr, Cu, and Ni in predetermined ranges and a balance of Fe and unavoidable impurities, in which the microstructure is a continuously cooled transformed structure, in which con-
(Continued)

tinuously cooled transformed structure, precipitates containing Nb have an average size of 1 to 3 nm and are included dispersed at an average density of 3 to $30\times10^{22}/m^3$, granular bainitic ferrite and/or quasi-polygonal ferrite are included in 50% or more in terms of fraction, furthermore, precipitates containing Ti nitrides are included, and they have an average circle equivalent diameter of 0.1 to 3 μm and include complex oxides including Ca, Ti, and Al in 50% or more in terms of number.

5 Claims, 1 Drawing Sheet

(51) Int. Cl.

| | |
|---|---|
| ***C21C 7/06*** | (2006.01) |
| ***C21D 1/18*** | (2006.01) |
| ***C21D 1/19*** | (2006.01) |
| ***C21D 7/04*** | (2006.01) |
| ***C21D 7/06*** | (2006.01) |
| ***C21D 9/46*** | (2006.01) |
| ***C22C 38/00*** | (2006.01) |
| ***C22C 38/02*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/58*** | (2006.01) |
| *C21D 9/08* | (2006.01) |

(52) U.S. Cl.

CPC ..... *C21D 1/18* (2013.01); *C21D 1/19* (2013.01); *C21D 7/04* (2013.01); *C21D 7/06* (2013.01); *C21D 8/021* (2013.01); *C21D 8/0226* (2013.01); *C21D 9/46* (2013.01); *C22C 38/001* (2013.01); *C22C 38/002* (2013.01); *C22C 38/02* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/58* (2013.01); *C21D 9/08* (2013.01); *C21D 9/085* (2013.01); *C21D 2211/002* (2013.01); *C21D 2211/004* (2013.01); *C21D 2211/005* (2013.01)

(56) References Cited

FOREIGN PATENT DOCUMENTS

| | | |
|---|---|---|
| JP | 10-183295 | 7/1998 |
| JP | 2004-315957 | 11/2004 |
| JP | 2005-503483 | 2/2005 |
| JP | 2005-146407 | 6/2005 |
| JP | 2005-240051 | 9/2005 |
| JP | 2005-281838 | 10/2005 |
| JP | 2006-161142 | 6/2006 |
| JP | 2006-274338 | 10/2006 |
| JP | 2008-056961 | 3/2008 |
| WO | WO 03/025241 | 3/2003 |
| WO | WO 2008/132882 | 11/2008 |

OTHER PUBLICATIONS

Hiroshi Asahi et al., "Development of Ultra High-strength Linepipe X120" Nippon Steel Technical Report No. 380 (2004), pp. 70-75 [with English Translation].

* cited by examiner

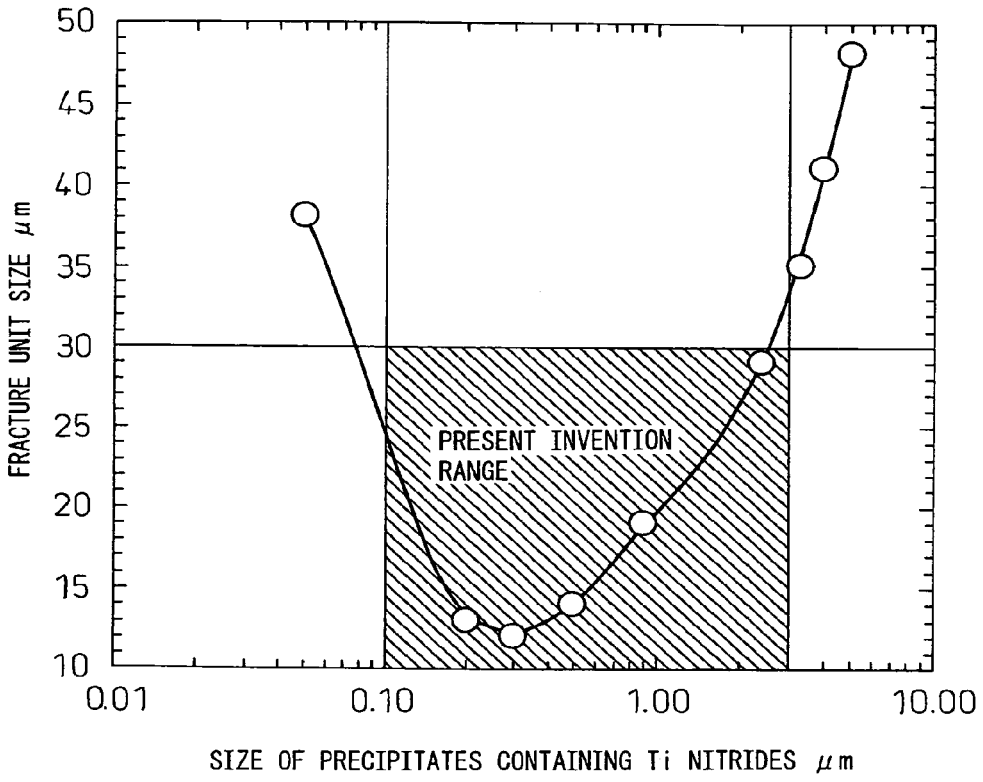
50
45
40
35
30
25
20
15
10
FRACTURE UNIT SIZE μm
PRESENT INVENTION
RANGE
0.01
0.10
1.00
10.00
SIZE OF PRECIPITATES CONTAINING Ti NITRIDES μm

HIGH STRENGTH HOT ROLLED STEEL SHEET FOR LINE PIPE USE EXCELLENT IN LOW TEMPERATURE TOUGHNESS AND DUCTILE FRACTURE ARREST PERFORMANCE AND METHOD OF PRODUCTION OF SAME

CROSS-REFERENCE TO RELATED APPLICATION

This application is a divisional application of U.S. application Ser. No. 12/736,903, filed Nov. 18, 2010, which is a national stage application of International Application No. PCT/JP2009/059922, filed May 25, 2009, which claims priority to Japanese Application Nos. 2008-137195, filed May 26, 2008, and 2009-077146, filed Mar. 26, 2009, each of which is incorporated by reference in its entirety.

TECHNICAL FIELD

The present invention relates to high strength hot rolled steel sheet for line pipe use excellent in low temperature toughness and ductile fracture arrest performance and a method of production of the same.

BACKGROUND ART

In recent years, the areas being developed for crude oil, natural gas, and other energy resources have spread to the North Sea, Siberia, North America, Sakhalin, and other artic regions and, further, the North Sea, the Gulf of Mexico, the Black Sea, the Mediterranean, the Indian Ocean, and other deep seas, that is, areas of harsh natural environments. Further, from the viewpoint of the emphasis on the global environment, natural gas development has been increasing. At the same time, from the viewpoint of the economy of pipeline systems, a reduction in the weight of the steel materials or higher operating pressures have been sought. To meet with these changes in the environmental conditions, the characteristics demanded from line pipe have become both higher and more diverse. Broadly breaking them down, there are demands for (a) greater thickness/higher strength, (b) higher toughness, (c) improved field weldability and accompanying lower carbon equivalents (Ceq), (d) tougher corrosion resistance, and (e) higher deformation performance in frozen areas and earthquake and fault zones. Further, these characteristics are usually demanded in combination in accordance with the usage environment.

Furthermore, due to the recent increase in crude oil and natural gas demand, far off areas for which development had been abandoned up to now due to lack of profitability and areas of harsh natural environments have begun to be developed in earnest. The line pipe used for pipelines for long distance transport of crude oil and natural gas is being required to be made thicker and higher in strength to improve the transport efficiency and also is being strongly required to be made higher in toughness so as to be able to withstand use in artic areas. Achievement of both these characteristics is an important technical goal.

In line pipe in artic zones, fractures are of a concern. The fractures due to the internal pressure of line pipe may be roughly divided into brittle fracture and ductile fracture. The arrest of propagation of the former brittle fracture can be evaluated by a DWTT (drop weight tear test) (which evaluates the toughness of steel in low temperature ranges by the ductile fracture rate and impart absorbed energy at the time of fracture of a test piece by an impact test machine), while the arrest of propagation of the latter ductile fracture can be evaluated by the impact absorbed energy of a Charpy impact test. In particular, in steel pipe for natural gas pipeline use, the internal pressure is high and the crack propagation rate is faster than the speed of the pressure wave after fracture, so there has been an increase in projects seeking not only low temperature toughness (brittle fracture resistance), but also high impact absorbed energy from the viewpoint of prevention of ductile fracture. Achievement of arrest properties of both brittle fracture and ductile fracture is now being sought.

On the other hand, steel pipe for line pipe use may be classified by production process into seamless steel pipe, UOE steel pipe, electric resistance welded steel pipe, and spiral steel pipe. These are selected in accordance with the application, size, etc. With the exception of seamless steel pipe, in each case, flat steel sheet or steel strip is shaped into a tube, then welded to obtain a steel pipe product. Furthermore, these welded steel pipe can be classified by the type of steel sheet used as material. Hot rolled steel sheet (hot coil) of a relatively thin sheet thickness is used by electric resistance welded steel pipe and spiral steel pipe, while thick-gauge sheet material (sheet) of a thick sheet thickness is used by UOE steel pipe. For high strength and large diameter, thick applications, the latter UOE steel pipe is generally used. However, from the viewpoint of cost and delivery, electric resistance welded steel pipe and spiral steel pipe using the former hot rolled steel sheet as a material are advantageous. Demand for higher strength, larger diameter, and greater thickness is increasing.

In UOE steel pipe, the art of production of high strength steel pipe corresponding to the X120 standard is disclosed (see NPLT 1). The above art is predicated on use of heavy sheet as a material. To obtain both high strength and greater thickness, interrupted direct quench (IDQ), a feature of the sheet production process, is used to achieve a high cooling rate and low cooling stop temperature. In particular, to ensure strength, quench hardening (structural strengthening) is utilized.

However, the art of IDQ cannot be applied to the hot rolled steel sheet used as a material for electric resistance welded steel pipe and spiral steel pipe. Hot rolled steel sheet is produced by a process including a coiling step. Due to the restrictions in capacity of coilers, it is difficult to coil a thick material at a low temperature. Therefore, the low temperature cooling stop required for quench hardening is impossible. Therefore, securing strength by quench hardening is difficult.

On the other hand, PLT 1 discloses, as art for hot rolled steel sheet achieving high strength, greater thickness, and low temperature toughness, the art of adding Ca and Si at the time of refining so as to make the inclusions spherical and, furthermore, adding the strengthening elements of Nb, Ti, Mo, and Ni and V having a crystal grain refinement effect and combining low temperature rolling and low temperature coiling. However, this art involves a final rolling temperature of 790 to 830° C., that is, a relatively low temperature, so there is a drop in absorbed energy due to separation and a rise in rolling load due to low temperature rolling and consequently problems remain in operational stability.

PLT 2 discloses, as art for hot rolled steel sheet considering field weldability and excellent in both strength and low temperature toughness, the art of limiting the PCM value to keep down the rise in hardness of the weld zone and making the microstructure a bainitic ferrite single phase and, furthermore, limiting the ratio of precipitation of Nb. However, this art also substantially requires low temperature rolling for obtaining a fine structure. There is a drop in absorbed energy due to separation and a rise in rolling load due to low temperature rolling and consequently problems remain in operational stability.

PLT 3 discloses the art of obtaining ultra high strength steel sheet excellent in high speed ductile fracture characteristics by making the ferrite area ratio of the microstructure 1 to 5% or over 5% to 60% and making the density of (100) of the cross-section rotated 45° from the rolling surface about the axis of the rolling direction not more than 3. However, this art is predicated on UOE steel pipe using heavy sheet as a material. It is not art covering hot rolled steel sheet.

CITATION LIST

Patent Literature

PLT 1: Japanese Patent Publication (A) No. 2005-503483
PLT 2: Japanese Patent Publication (A) No. 2004-315957
PLT 3: Japanese Patent Publication (A) No. 2005-146407

Non-Patent Literature

NPLT 1: Nippon Steel Technical Report, No. 380, 2004, page 70

SUMMARY OF INVENTION

Technical Problem

The present invention has as its object the provision of hot rolled steel sheet (hot coil) for line pipe use which can not only withstand use in regions where tough fracture resistance is demanded, but also in which API5L-X80 standard or better high strength and low temperature toughness and ductile fracture arrest performance can both be achieved even with a relatively thick sheet thickness of for example over half an inch (12.7 mm) and a method enabling that steel sheet to be produced inexpensively and stably.

Solution to Problem

The present invention was made to solve the above problem and has as its gist the following:

(1) High strength hot rolled steel sheet for line pipe use excellent in low temperature toughness and ductile fracture arrest performance containing, by mass %,
C=0.02 to 0.06%,
Si=0.05 to 0.5%,
Mn=1 to 2%,
P≤0.03%,
S≤0.005%,
O=0.0005 to 0.003%,
Al=0.005 to 0.03%,
N=0.0015 to 0.006%,
Nb=0.05 to 0.12%,
Ti=0.005 to 0.02%,
Ca=0.0005 to 0.003% and
N-14/48xTi≥0% and
Nb-93/14x(N-14/48xTi)>0.05%,
further containing
V≤0.3% (not including 0%),
Mo≤0.3% (not including 0%), and
Cr≤0.3% (not including 0%), where
0.2%≤V+Mo+Cr≤0.65%, containing
Cu≤0.3% (not including 0%) and
Ni≤0.3% (not including 0%), where
0.1%≤Cu+Ni≤0.5%, and
having a balance of
Fe and unavoidable impurities,
wherein in said steel sheet,
the microstructure is a continuously cooled transformed structure, in which continuously cooled transformed structure,
precipitates containing Nb have an average size of 1 to 3 nm and are included dispersed at an average density of 3 to $30\times10^{22}/m^3$,
granular bainitic ferrite $\alpha_B$ and/or quasi-polygonal ferrite $\alpha_q$ are included in 50% or more in terms of fraction,
furthermore, precipitates containing Ti nitrides are included, the precipitates containing Ti nitrides have an average circle equivalent diameter of 0.1 to 3 μm and include complex oxides including Ca, Ti, and Al in 50% or more in terms of number.

(2) High strength hot rolled steel sheet for line pipe use excellent in low temperature toughness and ductile fracture arrest performance as set forth in (1), further containing, by mass %,
B=0.0002 to 0.003%.

(3) High strength hot rolled steel sheet for line pipe use excellent in low temperature toughness and ductile fracture arrest performance as set forth in (1) or (2), further containing, by mass %,
REM=0.0005 to 0.02%.

(4) A method of production of high strength hot rolled steel sheet for line pipe use excellent in low temperature toughness and ductile fracture arrest performance comprising preparing molten steel for obtaining hot rolled steel sheet having the compositions as set forth in any one of claims 1 to 3 at which time preparing the molten steel to give a concentration of Si of 0.05 to 0.2% and a concentration of dissolved oxygen of 0.002 to 0.008%, adding to the molten steel Ti in a range giving a final content of 0.005 to 0.3% for deoxidation, then adding Al within 5 minutes to give a final content of 0.005 to 0.02%, furthermore adding Ca to give a final content of 0.0005 to 0.003%, then adding the required amounts of alloy ingredient elements to cause solidification, cooling a resultant cast slab, heating the cast slab to a temperature range of an SRT (° C.) calculated by formula (1) to 1260° C., further holding the slab at the temperature range for 20 minutes or more, then hot rolling by a total reduction rate of a non-recrystallization temperature range of 65% to 85%, ending the rolling in a temperature range of 830° C. to 870° C., then cooling in a temperature range down to 650° C. by a cooling rate of 2° C./sec to 50° C./sec and coiling at 500° C. to 650° C.:

$$SRT(^\circ C.)=6670/(2.26-\log([\%\ Nb]\times[\%\ C]))-273 \quad (1)$$

where [% Nb] and [% C] show the contents (mass %) of Nb and C in the steel material.

(5) A method of production of high strength hot rolled steel sheet for line pipe use excellent in low temperature toughness and ductile fracture arrest performance as set forth in (4) characterized by cooling before rolling in the non-recrystallization temperature range.

(6) A method of production of high strength hot rolled steel sheet for line pipe use excellent in low temperature toughness and ductile fracture arrest performance as set forth in (4) or (5) characterized by continuously casting the cast slab at which time lightly rolling it while controlling the amount of reduction so as to match solidification shrinkage at a final solidification position of the cast slab.

Advantageous Effects of Invention

By using the hot rolled steel sheet of the present invention for hot rolled steel sheet for electric resistance welded steel pipe and spiral steel pipe use in artic areas where tough fracture resistance properties are demanded, for example, even with a sheet thickness of over half an inch (12.7 mm), production of API5L-X80 standard or better high strength line pipe becomes possible. Not only this, but by using the method of production of the present invention, hot rolled steel sheet for electric resistance welded steel pipe and spiral steel pipe use can be inexpensively obtained in large volumes.

BRIEF DESCRIPTION OF DRAWINGS

FIG. 1 is a view showing the relationship between the size of the precipitates containing Ti nitrides and the DWTT brittle fracture unit.

EMBODIMENTS OF THE INVENTION

The present inventors etc. first investigated the relationship between the tensile strength and toughness of hot rolled steel sheet (hot coil) (in particular, the drop in Charpy absorbed energy ($vE_{-20}$) and the temperature at which the ductile fracture rate in a DWTT becomes 85% temperature ($FATT_{85\%}$)) and the microstructure etc. of steel sheet. They investigated this assuming the API5L-X80 standard. As a result, the present inventors etc. discovered that if analyzing the relationship between the Charpy absorbed energy ($vE_{-20}$), which is an indicator of the ductile fracture arrest performance, and the amount of addition of C, even with substantially the same strength, the more the amount of addition of C is increased, the more the Charpy absorbed energy ($vE_{-20}$) tends to fall.

Therefore, they investigated in detail the relationship of the $vE_{-20}$ and microstructure. As a result, a good correlation was observed between the $vE_{-20}$ and the fraction of the microstructure containing cementite and other coarse carbides such as pearlite. That is, it was observed that if such a microstructure increases, the $vE_{-20}$ tends to drop. Further, such a microstructure tends to increase together with an increase in the amount of addition of C. Conversely, along with a decrease in the fraction of a microstructure containing cementite and other coarse carbides, the fraction of the continuously cooled transformed structure (Zw) relatively increased.

A "continuously cooled transformed structure (Zw)", as described in Iron and Steel Institute of Japan, Basic Research Group, Bainite Investigation and Research Subgroup ed., Recent Research on Bainite Structure and Transformation Behavior of Low Carbon Steel (1994, Iron and Steel Institute of Japan), is a microstructure defined by a microstructure containing polygonal ferrite or pearlite formed by a diffusion mechanism and a transformed structure in the intermediate stage of martensite formed without diffusion by a shear mechanism.

That is, a continuously cooled transformed structure (Zw), as a structure observed under an optical microscope, as shown in the above reference literature, pages 125 to 127, is defined as a microstructure mainly comprised of bainitic ferrite ($\alpha^{\circ}_{B}$), granular bainitic ferrite ($\alpha_{B}$), and quasi-polygonal ferrite ($\alpha_{q}$) and furthermore containing small amounts of residual austenite ($\gamma_{r}$) and martensite-austenite (MA). $\alpha_{q}$, like polygonal ferrite (PF), does not reveal its internal structure by etching, but is acicular in shape and is clearly differentiated from PF. Here, if the circumferential length of the crystal grain covered is lq and its circle equivalent diameter is dq, the grains with a ratio of the same (lq/dq) satisfying lq/dq≥3.5 are $\alpha_{q}$.

The "fraction of a microstructure" is defined as the area fraction of the above continuously cooled transformed structure in the microstructure.

This continuously cooled transformed structure is formed since the Mn, Nb, V, Mo, Cr, Cu, Ni, and other strengthening elements added for securing strength when reducing the amount of addition of C cause an improvement in the quenchability. It is believed that when the microstructure is a continuously cooled transformed structure, the microstructure does not contain cementite and other coarse carbides, so the Charpy absorbed energy ($vE_{-20}$), the indicator of the ductile fracture arrest performance, is improved.

On the other hand, no clear correlation could be observed between the temperature in a DWTT test at which the ductile fracture rate becomes 85%, an indicator of the low temperature toughness (below, referred to as the "$FATT_{85\%}$,"), and the amount of addition of C. Further, even if the microstructure was a continuously cooled transformed structure, the $FATT_{85\%}$ did not necessarily improve. Therefore, the inventors etc. examined in detail the fracture planes after DWTT tests, whereupon they found the trend that good $FATT_{85\%}$'s were exhibited when the fracture unit of the cleavage plane of the brittle fracture is finer. In particular, the trend was shown that if the fracture unit becomes a circle equivalent diameter of 30 μm or less, the $FATT_{85\%}$ becomes good.

Therefore, the inventors etc. studied in detail the relationship between microstructures forming continuously cooled transformed structures and the $FATT_{85\%}$ indicator of low temperature toughness. They thereby found the trend that if the fraction of the granular bainitic ferrite ($\alpha_{B}$) or quasi-polygonal ferrite ($\alpha_{q}$) forming the continuously cooled transformed structures increases and the fraction becomes 50% or more, the fracture unit becomes a circle equivalent diameter of 30 μm or less and the $FATT_{85\%}$ becomes good. Conversely, they found the trend that if the fraction of the bainitic ferrite ($\alpha^{\circ}_{B}$) increases, the fracture unit conversely coarsens and the $FATT_{85\%}$ deteriorates.

In general, the bainitic ferrite ($\alpha^{\circ}_{B}$) forming a continuously cooled transformed structure is separated into a plurality of regions in the grain boundaries separated by the prior austenite grain boundaries and, furthermore, with crystal orientations in the same direction. These are called "packets". The effective crystal grain size, which is directly related to the fracture unit, corresponds to this packet size. That is, it is believed that if the austenite grains before transformation are coarse, the packet size also becomes coarse, the effective crystal grain size coarsens, the fracture unit coarsens, and the $FATT_{85\%}$ deteriorates.

Granular bainitic ferrite ($\alpha_{B}$) is a microstructure obtained by a more diffusive transformation than bainitic ferrite ($\alpha^{\circ}_{B}$) which occurs in a shearing manner in relatively large units even among the types of diffusive transformation. Quasi-polygonal ferrite ($\alpha_{q}$) is a microstructure obtained by even further diffusive transformation. Originally, this is not comprised of packets of a plurality of separate regions in the grain boundaries separated by the austenite grain boundaries and with crystal orientations in the same direction, but is granular bainitic ferrite ($\alpha_{B}$) or quasi-polygonal ferrite ($\alpha_{q}$) with the grains after transformation themselves in numerous orientations, so the effective crystal grain size, directly related to the fracture units, corresponds to the grain size of the same. For this reason, it is believed that the fracture units become finer and the $FATT_{85\%}$ is improved.

The inventors etc. engaged in further studies of the steel ingredients and production processes giving 50% or more fractions of granular bainitic ferrite ($\alpha_B$) or quasi-polygonal ferrite ($\alpha_q$) of structures forming a continuously cooled transformed structure.

To increase the fraction of granular bainitic ferrite ($\alpha_B$) or quasi-polygonal ferrite ($\alpha_q$), it is effective to increase the austenite crystal grain boundaries forming the nuclei of transformation of the microstructure, so the austenite grains before transformation have to be made finer. In general, to make austenite grains finer, it is effective to add Nb or other solute drag or pinning elements enhancing the controlled rolling (TMCP) effect. However, the fracture units and the change in $FATT_{85\%}$ due to the same were also observed with the same type of Nb content. Therefore, with addition of Nb or other solute drag or pinning elements, the austenite grains before transformation cannot be made sufficiently finer.

The inventors etc. investigated the microstructures in more detail, whereupon they found a good correlation between the fracture units after a DWTT test and the size of precipitates containing Ti nitrides. They confirmed the trend that if the average circle equivalent diameter of the size of precipitates containing Ti nitrides is 0.1 to 3 μm, the fracture unit after a DWTT test becomes finer and the $FATT_{85\%}$ is clearly improved.

Further, they discovered that the size and dispersion density of precipitates containing Ti nitrides can be controlled by deoxidation control in the smelting process. That is, they discovered that only when optimally adjusting the concentration of Si and the concentration of dissolved oxygen in the molten steel, adding Ti for deoxidation, then adding Al and further adding Ca in that order, the dispersion density of the precipitates containing Ti nitrides becomes $10^1$ to $10/m^2$ in range and the $FATT_{85\%}$ becomes good.

Furthermore, they learned that when optimally controlled in this way, the precipitates containing Ti nitrides include, in at least half by number, complex oxides containing Ca, Ti, and Al. Further, they newly discovered that by the optimum dispersion of these oxides, which form the nuclei for precipitation of the precipitates containing Ti nitrides, the precipitation size and dispersion density of the precipitates containing Ti nitrides are optimized and the austenite grain size before transformation kept fine as it is due to suppression of grain growth due to the pinning effect and that if the fraction of granular bainitic ferrite ($\alpha_B$) or quasi-polygonal ferrite ($\alpha_q$) transformed from the fine grain austenite becomes 50% or more, the $FATT_{85\%}$ indicator of low temperature toughness becomes good.

This is because if performing such deoxidation control, complex oxides containing Ca, Ti, and Al form over half of the total number of oxides. These fine oxides disperse in a high concentration. The average circle equivalent diameter of the precipitates containing Ti nitrides precipitating from these dispersed fine oxides as nucleation sites becomes 0.1 to 3 μm, so it is believed that the balance between the dispersion density and size is optimized, the pinning effect is exhibited to the maximum extent, and the effect of refining the austenite grain size before transformation becomes maximized. Note that, the complex oxides are allowed to contain some Mg, Ce, and Zr.

Next, the reasons for limitation of the chemical composition of the present invention will be explained. Here, the % for the compositions means mass %. C is an element necessary for obtaining the targeted strength (strength required by API5L-X80 standard) and microstructure. However, if less than 0.02%, the required strength cannot be obtained, while if adding over 0.06%, a large number of carbides, which form starting points of fracture, are formed, the toughness deteriorates, and also the field weldability significantly deteriorates. Therefore, the amount of addition of C is made 0.02% to 0.06%. Further, to obtain a homogeneous strength without regard to the cooling rate in cooling after rolling, not more than 0.05% is preferable.

Si has the effect of suppressing the precipitation of carbides—which form starting points of fracture. For this reason, at least 0.05% is added. However, if adding over 0.5%, the field weldability deteriorates. If considering general use from the viewpoint of field weldability, not more than 0.3% is preferable. Furthermore, if over 0.15%, tiger stripe-like scale patterns are liable to be formed and the beauty of the surface impaired, so preferably the upper limit should be made 0.15%.

Mn is a solution strengthening element. Further, it has the effect of broadening the austenite region temperature to the low temperature side and facilitating the formation of a continuously cooled transformed structure, one of the constituent requirements of the microstructure of the present invention, during the cooling after the end of rolling. To obtain this effect, at least 1% is added. However, even if adding over 2% of Mn, the effect becomes saturated, so the upper limit is made 2%. Further, Mn promotes center segregation in a continuous casting steel slab and causes the formation of hard phases forming starting points of fracture, so the content is preferably made not more than 1.8%.

P is an impurity and preferably is as low in content as possible. If over 0.03% is contained, this segregates at the center part of a continuous casting steel slab and causes grain boundary fracture and remarkably lowers the low temperature toughness, so the content is made not more than 0.03%. Furthermore, P has a detrimental effect on pipemaking and field weldability, so if considering this, the content is preferably made not more than 0.015%.

S is an impurity. It not only causes cracks at the time of hot rolling, but also, if too great in content, causes deterioration of the low temperature toughness. Therefore, the content is made not more than 0.005%. Furthermore, S segregates near the center of a continuous casting steel slab, forms elongated MnS after rolling, and forms starting points for hydrogen induced cracking. Not only this, "two sheet cracking" and other pseudo-separation are liable to occur. Therefore, if considering the sour resistance, the content is preferably not more than 0.001%.

O is an element required for causing dispersion of a large number of fine oxides at the time of deoxidation of molten steel, so at least 0.0005% is added, but if the content is too great, it will form coarse oxides forming starting points of fracture in the steel and cause deterioration of the brittle fracture and hydrogen induced cracking resistance, so the content is made not more than 0.003%. Furthermore, from the viewpoint of the field weldability, a content of not more than 0.002% is preferable.

Al is an element required for causing dispersion of a large number of fine oxides at the time of deoxidation of molten steel. To obtain this effect, at least 0.005% is added. On the other hand, if excessively adding this, the effect is lost, so the upper limit is made 0.03%.

Nb is one of the most important elements in the present invention. Nb suppresses the recovery/recrystallization and grain growth of austenite during rolling or after rolling by the dragging effect in the solid solution state and/or the pinning effect as a carbonitride precipitate, makes the effective crystal grain size finer, and reduces the fracture unit in crack propagation of brittle fracture, so has the effect of improving the low temperature toughness. Furthermore, in the coiling process, a feature of the hot rolled steel sheet production process, it forms fine carbides and, by the precipitation strengthening of the same, contributes to the improvement of the strength. In addition, Nb delays the $\gamma/\alpha$ transformation and lowers the transformation temperature and thereby has the effect of stably making the microstructure after transformation a continuously cooled transformed structure even at a relatively slow cooling rate. However, to obtain these effects, at least 0.05% must be added. On the other hand, if adding over 0.12%, not only do the effects become saturated, but also formation of a solid solution in the heating process before hot rolling becomes difficult, coarse carbonitrides are formed and form starting points of fracture, and therefore the low temperature toughness and sour resistance are liable to be degraded.

Ti is one of the most important elements in the present invention. Ti starts to precipitate as a nitride at a high temperature right after solidification of a cast slab obtained by continuous casting or ingot casting. These precipitates containing Ti nitrides are stable at a high temperature and will not dissolve at all even during subsequent slab reheating, so exhibit a pinning effect, suppress the coarsening of austenite grains during reheating, refine the microstructure, and thereby improve the low temperature toughness. Further, Ti has the effect of suppressing the formation of nuclei for formation of ferrite in $\gamma/\alpha$ transformation and promoting the formation of the continuously cooled transformed structure of one of the requirements of the present invention. To obtain such an effect, addition of at least 0.005% of Ti is required. On the other hand, even if adding over 0.02%, the effect is saturated. Furthermore, if the amount of addition of Ti becomes less than the stoichiometric composition with N ($N-14/48xTi<0\%$), the residual Ti will bond with C and the finely precipitated TiC is liable to cause deterioration of the low temperature toughness. Further, Ti is an element required for causing dispersion of a large number of fine oxides at the time of deoxidation of the molten steel. Furthermore, using these fine oxides as nuclei, precipitates containing Ti nitrides finely crystallize or precipitate, so this also has the effect of reducing the average circle equivalent diameter of the precipitates containing Ti nitrides and cause dense dispersion and thereby the effect of suppressing recovery/recrystallization of austenite during rolling or after rolling and also suppressing grain growth of ferrite after coiling.

Ca is an element required for causing dispersion of a large number of fine oxides at the time of deoxidation of molten steel. To obtain that effect, at least 0.0005% is added. On the other hand, even if adding more than 0.003%, the effect becomes saturated, so the upper limit is made 0.003%. Further, Ca, in the same way as REM, is an element which changes the form of nonmetallic inclusions, which would otherwise form starting points for fracture and cause deterioration of the sour resistance, to render them harmless.

N, as explained above, forms precipitates containing Ti nitrides, suppresses coarsening of austenite grains during slab reheating to make the austenite grain size, which is correlated with the effective crystal grain size in the later controlled rolling, finer, and makes the microstructure a continuously cooled transformed structure to thereby improve the low temperature toughness. However, if the content is less than 0.0015%, that effect cannot be obtained. On the other hand, if over 0.006% is contained, with aging, the ductility falls and the shapeability at the time of pipe-making falls. As explained before, if the N content becomes less than the stoichiometric composition with Ti ($N-14/48xTi<0\%$), the residual Ti will bond with C and the finely precipitating TiC is liable to cause deterioration of the low temperature toughness. Furthermore, with a stoichiometric composition of Nb, Ti, and N of $Nb-93/14x(N-14/48xTi)\leq 0.05\%$, the amount of fine precipitates containing Nb formed in the coiling process decreases and the strength falls. Therefore, $N-14/48xTi\geq 0\%$ and $Nb-93/14x(N-14/48xTi)>0.05\%$ are defined.

Next, the reasons for adding V, Mo, Cr, Ni, and Cu will be explained. The main objective of further adding these elements to the basic ingredients is to increase the thickness of the sheet which can be produced and improve the strength, toughness, and other properties of the base material without detracting from the superior features of the steel of the present invention. Therefore, these elements are ones with self-restricted amounts of addition by nature.

V forms fine carbonitrides in the coiling process and contributes to the improvement of the strength by precipitation strengthening. However, even if adding more than 0.3%, that effect becomes saturated, so the content was made not more than 0.3% (not including 0%). Further, if adding 0.04% or more, there is a concern over reduction of the field weldability, so less than 0.04% is preferable.

Mo has the effect of enhancement of the quenchability and improvement of the strength. Further, Mo, in the copresence of Nb, has the effect of strongly suppressing the recrystallization of austenite during controlled rolling, making the austenite structure finer, and improving the low temperature toughness. However, even if adding over 0.3%, the effect becomes saturated, so the content is made not more than 0.3% (not including 0%). Further, if adding 0.1% or more, there is a concern that the ductility will fall and the shapeability when forming pipe will fall, so less than 0.1% is preferable.

Cr has the effect of raising the strength. However, even if adding over 0.3%, the effect will become saturated, so the content is made not more than 0.3% (not including 0%). Further, if adding 0.2% or more, there is a concern over reduction of the field weldability, so less than 0.2% is preferable. Further, if V+Mo+Cr is less than 0.2%, the targeted strength is not obtained, while even if adding more than 0.65%, the effect becomes saturated. Therefore, $0.2\% V+Mo+Cr\leq 0.65\%$ is prescribed.

Cu has the effect of improvement of the corrosion resistance and the hydrogen induced cracking resistance. However, even if adding more than 0.3%, the effect becomes saturated, so the content is made not more than 0.3% (not including 0%). Further, if adding 0.2% or more, embrittlement cracking is liable to occur at the time of hot rolling and to become a cause of surface defects, so less than 0.2% is preferable.

Ni, compared with Mn or Cr and Mo, forms fewer hard structures harmful to the low temperature toughness and sour resistance in the rolled structure (in particular, the center segregation zone of the slab) and therefore has the effect of improving the strength without causing deterioration of the low temperature toughness and field weldability. However, even if adding over 0.3%, the effect becomes saturated, so the content is made not more than 0.3% (not including 0%). Further, there is an effect of prevention of hot embrittlement of Cu, so at least ½ of the amount of the Cu is added as a general rule.

Further, if Cu+Ni is less than 0.1%, the effect of improvement of the strength without causing deterioration of the corrosion resistance, hydrogen induced cracking resistance, low temperature toughness, and field weldability is not obtained, while if over 0.5%, the effect becomes saturated. Therefore, 0.1%≤Cu+Ni≤0.5% is defined.

B has the effect of improving the quenchability and facilitating the formation of a continuously cooled transformed structure. Furthermore, B has the effect of enhancing the effect of improvement of the quenchability of Mo and of increasing the quenchability synergistically with the copresence of Nb. Therefore, this is added as required. However, if less than 0.0002%, this is not enough for obtaining those effects, while if adding over 0.003%, slab cracking occurs.

REMs are elements which change the form of nonmetallic inclusions, which would otherwise form starting points of fracture and cause deterioration of the sour resistance, to render them harmless. However, if adding less than 0.0005%, there is no such effect, while if adding over 0.02%, large amounts of the oxides are formed resulting in the formation of clusters and coarse inclusions which cause deterioration of the low temperature toughness of the weld seams and have a detrimental effect on the field weldability as well.

Next, the microstructure of the steel sheet in the present invention will be explained in detail. To obtain strength of the steel sheet, the microstructure must have nanometer size precipitates containing Nb densely dispersed in it. Further, to improve the absorbed energy, the indicator of the ductile fracture arrest performance, a microstructure containing cementite and other coarse carbides must not be included. Furthermore, to improve the low temperature toughness, the effective crystal grain size must be reduced. To observe and measure the nanometer size precipitates containing Nb effective for precipitation strengthening for obtaining strength of the steel sheet, thin film observation using a transmission type electron microscope or measurement by the 3D atom probe method is effective. Therefore, the inventors etc. used the 3D atom probe method for measurement.

As a result, in samples given a strength corresponding to API5L-X80 by precipitation strengthening, the size of the precipitates containing Nb extended between 0.5 to 5 nm and the average size was 1 to 3 nm. The measurement results of the precipitates containing Nb distributed at a density of 1 to $50\times10^{22}/m^3$ and having an average density of 3 to $30\times10^{22}/m^3$ were obtained. The average size of the precipitates containing Nb, if less than 1 nm, is too small and therefore the precipitation strengthening ability is not sufficiently manifested, while if over 3 nm, the precipitates are transitory, the match with the base phase is lost, and the effect of precipitation strengthening is reduced. If the average density of the precipitates containing Nb is less than $3\times10^{22}/m^3$, the density is not sufficient for precipitation strengthening, while if over $30\times10^{22}/m^3$, the low temperature toughness deteriorates. Here, the "average" is the arithmetic average of the number. These nanosize precipitates are mainly comprised of Nb, but are allowed to also include the carbonitride-forming Ti, V, Mo, and Cr.

Note that, in the 3D atom probe method, an FIB (focused ion beam) apparatus/FB2000A made by Hitachi Ltd. was used, and a cut out sample was electrolytically ground to a needle shape by using a freely shaped scanning beam to make the grain boundary part a needle point shape. The sample was given contrast at the crystal grains differing in orientation by the channeling phenomenon of an SIM (scan electron microscope) and, while observing this, was cut at a position including a plurality of grain boundaries by an ion beam. The apparatus used as the 3D atom probe was an OTAP made by CAMECA. The measurement conditions were a sample position temperature of about 70K, a probe total voltage of 10 to 15 kV, and a pulse ratio of 25%. Each sample was measured three times and the average value used as the representative value.

Next, to improve the absorbed energy, the indicator of the ductile fracture arrest performance, it is necessary that no microstructure containing cementite or other coarse carbides be included. That is, the continuously cooled transformed structure in the present invention is a microstructure containing one or more of $\alpha^{\circ}_B$, $\alpha_B$, $\alpha_q$, $\gamma_r$, and MA, but here, since $\alpha^{\circ}_B$, $\alpha_B$, and $\alpha_q$ do not contain cementite or other coarse carbides, if their fraction is large, an improvement in the absorbed energy indicator of ductile fracture arrest performance can be expected. Furthermore, small amounts of $\gamma_r$ and MA may be included, but the total amount should be not more than 3%.

To improve the low temperature toughness, to reduce the effective crystal grain size, it is not enough just that the microstructure have a continuously cooled transformed structure. It is necessary that the $\alpha_B$ and/or $\alpha_q$ structures forming the continuously cooled transformed structure be 50% or more in fraction in the continuously cooled transformed structure. If the fraction of these microstructures is 50% or more, the effective crystal grain size, which is directly related with the fracture unit considered the main influential factor in cleavage fracture propagation in brittle fracture, becomes finer and the low temperature toughness is improved.

Further, to obtain the above microstructure, the average circle equivalent diameter of the precipitates containing Ti nitrides has to be 0.1 to 3 μm and, furthermore, at least half of them by number have to contain complex oxides containing Ca, Ti, and Al. That is, to obtain, as a fraction, 50% or more of the $\alpha_B$ and/or $\alpha_q$ structures forming the continuously cooled transformed structure, it is important to make the austenite grain size before transformation finer. For this reason, the average circle equivalent diameter of the size of the precipitates containing Ti nitrides has to be 0.1 to 3 μm (preferably 2 μm or less) and the density has to be $10^1$ to $10^3/mm^2$.

To control the average circle equivalent diameter of size and the density of the precipitates containing Ti nitrides, it is sufficient that the oxides of Ca, Ti, and Al forming the precipitation nuclei of these be optimally dispersed. Due to this, the precipitation size and dispersion density of the precipitates containing Ti nitrides are optimized, the austenite grain size before transformation is kept fine due to suppression of grain growth by the pinning effect, and therefore the austenite can be made finer. As a result, it is learned that at least half of the number of the precipitates containing Ti nitrides should contain complex oxides containing Ca, Ti, and Al. Note that, the complex oxides are allowed to contain some Mg, Ce, and Zr. Further, here, the "average" is the arithmetic average of the number.

Next, the reasons for limitation of the method of production of the present invention will be explained in detail.

In the present invention, the process up to the primary refining by a converter or electric furnace is not particularly limited. That is, it is sufficient to tap the pig iron from a blast furnace, then dephosphorize, desulfurize, and otherwise pretreat the molten pig iron, then refine it by a converter or to melt scrap or other cold iron sources by an electric furnace etc.

The secondary refining process after the primary refining is one of the most important production processes of the present invention. That is, to obtain the precipitates containing Ti nitrides of the targeted composition and size, complex oxides containing Ca, Ti, and Al must be made to finely disperse in the steel in the deoxidation process. This can first be realized by successively adding weak deoxidizing elements to strong deoxidizing elements in the deoxidation process (successive strength deoxidation).

"Successive strength deoxidation" is a deoxidation method which makes use of the phenomenon that by adding strong deoxidizing elements to molten steel in which weak deoxidizing element oxides are present, the weak deoxidizing element oxides are reduced and oxygen is released in a state of a slow feed rate and small supersaturation degree, whereupon the oxides formed from the added strong deoxidizing elements become finer. By adding deoxidizing elements in stages from the weak deoxidizing element Si successively to Ti and Al and to the strong deoxidizing element Ca, these effects can be exhibited to the maximum extent. This will be explained in sequence below.

First, the amount of Si, which is a weaker deoxidizing element than even Ti, is adjusted to make the concentration of dissolved oxygen in equilibrium with the amount of S 0.002 to 0.008%. If the concentration of the dissolved oxygen is less than 0.002%, finally a sufficient amount of complex oxides containing Ca, Ti, and Al for reducing the size of the precipitates containing Ti nitrides cannot be obtained. On the other hand, if over 0.008%, the complex oxides formed coarsen and the effect of reducing the size of the precipitates containing Ti nitrides is lost.

Further, to stably adjust the concentration of dissolved oxygen at the preceding stage of deoxidation, addition of Si is necessary. If the concentration of Si is less than 0.05%, the concentration of dissolved oxygen in equilibrium with Si becomes over 0.008%, while if over 0.2%, the concentration of dissolved oxygen in equilibrium with Si becomes less than 0.002%. Therefore, in the preceding stage of deoxidation, the concentration of Si is made 0.05 to 0.2% and the concentration of dissolved oxygen is made 0.002% to 0.008%.

Next, in the state of this concentration of dissolved oxygen, Ti is added in a range giving a final content of 0.005 to 0.3% for deoxidation, then immediately Al is added to give a final content of 0.005 to 0.02%. At this time, the Ti oxides formed would grow, agglomerate, coarsen, and rise up together with the elapse of time after charging the Ti, so the Al is immediately charged. However, if within 5 minutes, the rise of Ti oxides would not be that significant, so the Al is preferably charged within 5 minutes from the charging of the Ti. Further, if the amount of Al charged is one where the final content becomes less than 0.005%, the Ti oxides will grow, agglomerate, coarsen, and rise up. On the other hand, if the amount of Al charged is an amount by which the final content exceeds 0.02%, the Ti oxides will end up being completely reduced and finally complex oxides containing Ca, Ti, and Al will not be sufficiently obtained.

Next, Ca, which is a stronger deoxidizing element than Ti and Al, is preferably charged within 5 minutes to give a final content of 0.0005 to 0.003%. However, after this, in accordance with need, these elements and other alloy ingredient elements insufficient in amount may be added. Here, if the amount of Ca charged is an amount giving a final content of less than 0.0005%, complex oxides containing Ca, Ti, and Al cannot be sufficiently obtained. On the other hand, if added to become over 0.003%, the oxides containing Ti and Al will end up being completely reduced to Ca and the effects will be lost.

A slab cast by continuous casting or thin slab casting may be directly charged as is as a high temperature cast slab to the hot rolling stand. Further, the slab may be cooled to room temperature, then reheated at a heating furnace, then hot rolled. However, when performing hot charge rolling (HCR), due to the $\gamma \rightarrow \alpha \rightarrow \gamma$ transformation, the cast structure is destroyed and the austenite grain size at the time of slab reheating is reduced, so the steel is preferably cooled to less than the Ar3 transformation point temperature. Furthermore, it preferably is cooled to less than the Ar1 transformation point temperature.

From the viewpoint of the sour resistance, center segregation is preferably reduced as much as possible. Therefore, the slab is cast with light rolling in accordance with the specifications sought.

Segregation of Mn etc. raises the quenchability of the segregated part to cause hardening of the structure and, together with the presence of inclusions, promotes hydrogen induced cracking.

To suppress segregation, light rolling at the time of final solidification in continuous casting is optimum. The light rolling at the time of final solidification is performed so as to suppress movement of concentrated molten steel to the unsolidified part at the center, caused by the movement of concentrated molten steel due to solidification shrinkage etc., by compensating for the amount of solidification shrinkage. Light rolling is performed while controlling the amount of reduction so as to be commensurate with the solidification shrinkage at the final solidification position of the cast slab. Due to this, it is possible to reduce center segregation.

The specific conditions of the light rolling are a roll pitch, in the facility at the position corresponding to the end of solidification where the center solid phase rate becomes 0.3 to 0.7, of 250 to 360 mm and a reduction rate, expressed by the product of the casting rate (m/min) and rolling set gradient (mm/m), of 0.7 to 1.1 mm/min in range.

At the time of hot rolling, the slab reheating temperature (SRT) is made a temperature calculated by the following formula (1)

$$SRT(^\circ C.)=6670/(2.26-\log([\%\ Nb]\times[\%\ C]))-273 \quad (1)$$

where, [% Nb] and [% C] show the contents (mass %) of Nb and C in the steel materials. This formula shows the solubilization temperature of NbC by the NbC solubility product. If less than this temperature, the coarse precipitates containing Nb formed at the time of slab production will not sufficiently melt and the effect of crystal grain refinement caused by suppression of the recovery/recrystallization and grain growth of austenite by Nb in the later rolling process and the delay of $\gamma/\alpha$ transformation cannot be obtained. Further, not only this, the effect of the formation of fine carbides and the improvement of strength by their precipitation strengthening in the coiling process, a feature of the hot rolled steel sheet production process, cannot be obtained. However, if heating at less than 1100° C., the amount of scale-off becomes small and there is a possibility that inclusions at the slab surface can no longer be removed together with the scale in the subsequent descaling, so the slab reheating temperature is preferably 1100° C. or more.

On the other hand, if over 1260° C., the grain size of the austenite becomes coarser, the prior austenite grains in the subsequent controlled rolling coarsen, a granular microstructure cannot be obtained after transformation, and the effect of improvement of the $FATT_{85\%}$ due to the effect of refinement of the effective crystal grain size cannot be expected. More preferably, the temperature is 1230° C. or so.

The slab heating time is made at least 20 minutes from reaching the above temperature so as to enable sufficient melting of the precipitates containing Nb. If less than 20 minutes, the coarse precipitates containing Nb formed at the time of slab production will not sufficiently melt, and the effect of refinement of the crystal grains due to suppression of recovery/recrystallization and grain growth of the austenite during the hot rolling and the delay of $\gamma/\alpha$ transformation and the effect of the formation of fine carbides and the improvement of strength by their precipitation strengthening in the coiling process cannot be obtained.

The following hot rolling process usually is comprised of a rough rolling process performed by several rolling stands including a reverse rolling stand and a final rolling process performed by six to seven rolling stands arranged in tandem. In general, the rough rolling process has the advantages that the number of passes and the rolling rates at the individual passes can be freely set, but the time between passes is long and the structure is liable to recover/recrystallize between the passes. On the other hand, the final rolling process employs a tandem setup, so the number of passes becomes the same as the number of rolling stands, but the time between passes is short and the effects of controlled rolling can be easily obtained. Therefore, to realize superior low temperature toughness, the process has to be designed making full use of the features of these rolling processes in addition to the steel ingredients.

Further, for example, in the case of a product thickness over 20 mm, if the roll gap in the #1 final rolling stand is 55 mm or less due to restrictions in the facilities, with the final rolling process alone, the requirement of the present invention, that is, the condition of the total reduction rate of the non-recrystallization temperature range being at least 65%, cannot be satisfied, so controlling rolling in the non-recrystallization temperature range may also be performed after the rough rolling process. In the above case, if necessary, it is possible to wait until the temperature falls to the non-recrystallization temperature range or to use a cooling apparatus for cooling. The latter case enables the waiting time to be shortened, so is more preferable in terms of productivity.

Furthermore, a sheet bar may be attached between the rough rolling and final rolling to enable continuous final rolling. At that time, the coarse bar is coiled up once, stored in a cover having a heat retaining function if necessary, and then again unwound and attached.

In the rough rolling process, the rolling is mainly performed in the recrystallization temperature range. The reduction rates in the individual rolling passes are not limited in the present invention. However, if the reduction rates at the individual passes of the rough rolling are 10% or less, sufficient strain required for recrystallization is not introduced, grain growth occurs due to only grain boundary movement, the grains coarsen, and the low temperature toughness is liable to deteriorate, so it is preferable to perform the rolling by reduction rates over 10% in the respective rolling passes in the recrystallization temperature range. Similarly, if the reduction rates at the rolling passes in the recrystallization temperature range are 25% or more, particularly in the later low temperature range, dislocation cell walls will be formed due to the repeated introduction of dislocations and recovery during the rolling and dynamic recrystallization involving a change from sub-grain to large angle grain boundaries will occur. In a structure like a microstructure mainly comprised of such dynamic recrystallization grains where high dislocation density grains and other grains are mixed, grain growth occurs in a short time, so relatively coarse grains are liable to be grown before the non-recrystallization region rolling, grains are liable to end up being formed by the later non-recrystallization region rolling, and therefore the low temperature toughness is liable to deteriorate. Therefore, the reduction rates in the rolling passes in the recrystallization temperature range are preferably made less than 25%.

In the final rolling process, the rolling is performed in the non-recrystallization temperature range, but when the temperature at the end of the rough rolling does not reach the non-recrystallization temperature range, if necessary it is waited until the temperature falls to the non-recrystallization temperature range or, if necessary, cooling is performed by a cooling apparatus between the rough/final rolling stands. In the latter case, the waiting time can be shortened, so the productivity is improved. Not only that, the growth of recrystallization grains is suppressed and the low temperature toughness can be improved. This is therefore more preferable.

If the total reduction rate in the non-recrystallization temperature range is less than 65%, the controlled rolling becomes insufficient, prior austenite grains coarsen, a granular microstructure cannot be obtained after transformation, and the effect of improvement of the $FATT_{85\%}$ due to the effect of refinement of the effective crystal grain size cannot be expected, so the total reduction rate in the non-recrystallization temperature range is made 65% or more. Furthermore, to obtain a superior low temperature toughness, 70% or more is preferable. On the other hand, if over 85%, the excessive rolling causes an increase in the density of the dislocations forming nuclei for ferrite transformation and causes polygonal ferrite to be mixed in the microstructure. Further, due to the high temperature ferrite transformation, the precipitation strengthening of the Nb becomes transitory and the strength falls. Further, due to crystal rotation, the anisotropy of the structure after transformation becomes remarkable, the plastic anisotropy increases, and a drop in the absorbed energy due to the occurrence of separation is liable to be invited. Therefore, the total reduction rate in the non-recrystallization temperature range is made not more than 85%.

The final rolling end temperature is 830° C. to 870° C. In particular if less than 830° C. at the center part of sheet thickness, remarkable separation occurs at the ductile fracture planes and the absorbed energy remarkably falls, so the final rolling end temperature at the center part of sheet thickness is made at least 830° C. Further, the sheet surface temperature is also preferably made at least 830° C. On the other hand, if 870° C. or more, even if the precipitates containing Ti nitrides are optimally present in the steel, recrystallization is liable to cause the austenite grain size to coarsen and the low temperature toughness to deteriorate. Further, if performing the final rolling at the low temperature of the Ar3 transformation point temperature or less, dual-phase rolling results, the absorbed energy drops due to the occurrence of separation, and, in the ferrite phase, due to the reduction, the dislocation density increases, the precipitation strengthening by Nb becomes transitory, and the strength falls. Further, the worked ferrite structure falls in ductility.

Even without particularly limiting the rolling pass schedule at the different stands in the final rolling, the effects of the present invention can be obtained, but from the viewpoint of the precision of sheet shape, the rolling rate at the final stand is preferable less than 10%.

Here, the "$Ar_3$ transformation point temperature" is for example simply shown in relation to the steel ingredients by the following formula. That is, $Ar_3=910-310x\ \%\ C+25x\ \%\ Si-80x\ \%\ Mneq$ where, $Mneq=Mn+Cr+Cu+Mo+Ni/2+10(Nb-0.02)$ Alternatively, this is the case of addition of Mneq=Mn+Cr+Cu+Mo+Ni/2+10(Nb−0.02)+1:B.

After the end of the final rolling, the cooling is started. The cooling start temperature is not particularly limited, but if starting the cooling from less than the $Ar_3$ transformation point temperature, the microstructure will contain large amounts of polygonal ferrite and the strength is liable to drop, so the cooling start temperature is preferably at least the $Ar_3$ transformation point temperature.

The cooling rate in the temperature range from the start of cooling to 650° C. is made 2° C./sec to 50° C./sec. If this cooling rate is less than 2° C./sec, the microstructure will contain large amounts of polygonal ferrite and the strength is liable to drop. On the other hand, with a cooling rate of over 50° C./sec, heat strain is liable to cause warping, so the rate is made not more than 50° C./sec.

Further, when the occurrence of separation at the fracture plane results in the predetermined absorbed energy not being obtained, the cooling rate is made at least 15° C./sec. Furthermore, if 20° C./sec or more, it is possible to improve the strength without changing the steel ingredients and without causing deterioration of the low temperature toughness, so the cooling rate is preferably made at least 20° C./sec.

The cooling rate in the temperature range from 650° C. to coiling may be air cooling or a cooling rate corresponding to the same. However, to obtain the maximum effect of precipitation strengthening by Nb etc., to prevent the precipitate from coarsening and thereby becoming transitory, the average cooling rate from 650° C. to coiling is preferably at least 5° C./sec.

After cooling, the coiling process, a feature of the hot rolled steel sheet production process, is effectively utilized. The cooling stop temperature and coiling temperature are made temperature ranges of 500° C. to 650° C. If stopping the cooling at over 650° C. and then coiling, the precipitates containing Nb will become transitory and precipitation strengthening will no longer be sufficiently exhibited. Further, coarse precipitates containing Nb will form and act as starting points for fracture and therefore the ductile fracture arresting ability, low temperature toughness, and sour resistance are liable to be degraded. On the other hand, if ending the cooling at less than 500° C. and then coiling, the fine precipitates containing Nb so effective for obtaining the target strength will not be obtained and the target strength will no longer be able to be obtained. Therefore, the temperature range for stopping the cooling and coiling is made 500° C. to 650° C.

EXAMPLES

Below, examples will be used to explain the present invention in more detail. Steels of the chemical ingredients shown in Table 2 were smelted in a converter and secondarily refined by CAS or RH. The deoxidation was performed by the secondary refining process. As shown in Table 1, before charging the Ti, the dissolved oxygen of the molten steel was adjusted by the concentration of Si, then successive deoxidation was performed by Ti, Al, and Ca. These steels were continuously cast, then directly charged or reheated and reduced to a sheet thickness of 20.4 mm by rough rolling and then final rolling, then were cooled at a runout table, then coiled. The chemical compositions in the tables are shown in mass %. Further, the N* in Table 2 means the value of N-14/48xTi.

TABLE 1

| | Production conditions Smelting process | | | | |
|---|---|---|---|---|---|
| Steel | Concentration of Si before charging Ti (%) | Equilibrium dissolved oxygen concentration (%) | Order of charging Ti, Al, and Ca | Time until charging Al after Ti deoxidation (min) | Remarks |
| A | 0.05 | 0.0037 | Ti→Al→Ca | 1.0 | Inv. ex. |
| B | 0.115 | 0.0036 | Ti→Al→Ca | 21.0 | Comp. ex. |
| C | 0.048 | 0.0083 | Ti→Al→Ca | 1.0 | Comp. ex. |
| D | 0.121 | 0.0032 | Al→Ti→Ca | — | Comp. ex. |
| E | 0.132 | 0.0030 | Ti→Al→Ca | 1.0 | Inv. ex. |
| F | 0.052 | 0.0077 | Ti→Al→Ca | 2.0 | Inv. ex. |
| G | 0.050 | 0.0074 | Ti→Al→Ca | 1.5 | Inv. ex. |
| H | 0.056 | 0.0068 | Ti→Al→Ca | 0.6 | Inv. ex. |
| I | 0.165 | 0.0024 | Ti→Al→Ca | 2.0 | Inv. ex. |
| J | 0.132 | 0.0029 | Ti→Al→Ca | 3.0 | Inv. ex. |
| K | 0.188 | 0.0022 | Ti→Al→Ca | 2.5 | Inv. ex. |
| L | 0.121 | 0.0030 | Ti→Al→Ca | 4.5 | Inv. ex. |
| M | 0.132 | 0.0031 | Ca→Al→Ti | — | Comp. ex. |
| N | 0.101 | 0.0029 | Ti→Al→Ca | 5.0 | Inv. ex. |
| O | 0.160 | 0.0022 | Ti→Al→Ca | 2.1 | Inv. ex. |
| P | 0.131 | 0.0028 | Ti→Al→Ca | 2.9 | Inv. ex. |
| Q | 0.184 | 0.0021 | Ti→Al→Ca | 2.3 | Inv. ex. |
| R | 0.120 | 0.0031 | Ti→Al→Ca | 4.4 | Inv. ex. |

TABLE 2

| | Chemical composition (unit: mass%) | | | | | | | | | | | | |
|---|---|---|---|---|---|---|---|---|---|---|---|---|---|
| Steel | C | Si | Mn | P | S | O | Al | N | Nb | Ti | V | Mo | Cr |
| A | 0.045 | 0.14 | 1.76 | 0.009 | 0.001 | 0.0019 | 0.023 | 0.0038 | 0.077 | 0.012 | 0.039 | 0.09 | 0.19 |
| B | 0.046 | 0.13 | 1.73 | 0.011 | 0.001 | 0.0018 | 0.020 | 0.0038 | 0.075 | 0.012 | 0.038 | 0.10 | 0.20 |
| C | 0.047 | 0.13 | 1.75 | 0.008 | 0.001 | 0.0017 | 0.020 | 0.0042 | 0.076 | 0.013 | 0.036 | 0.09 | 0.19 |
| D | 0.045 | 0.14 | 1.75 | 0.010 | 0.001 | 0.0018 | 0.022 | 0.0039 | 0.077 | 0.013 | 0.039 | 0.08 | 0.18 |
| E | 0.071 | 0.25 | 1.87 | 0.008 | 0.002 | 0.0017 | 0.020 | 0.0037 | 0.039 | 0.012 | 0.000 | 0.00 | 0.20 |
| F | 0.059 | 0.25 | 1.74 | 0.002 | 0.002 | 0.0019 | 0.023 | 0.0034 | 0.056 | 0.011 | 0.070 | 0.26 | 0.21 |
| G | 0.029 | 0.29 | 1.65 | 0.003 | 0.002 | 0.0017 | 0.020 | 0.0043 | 0.101 | 0.014 | 0.032 | 0.24 | 0.16 |
| H | 0.066 | 0.22 | 1.54 | 0.009 | 0.001 | 0.0022 | 0.029 | 0.0033 | 0.051 | 0.021 | 0.030 | 0.11 | 0.11 |
| I | 0.067 | 0.25 | 1.60 | 0.010 | 0.002 | 0.0021 | 0.022 | 0.0038 | 0.068 | 0.003 | 0.055 | 0.07 | 0.11 |
| J | 0.016 | 0.49 | 1.79 | 0.028 | 0.001 | 0.0011 | 0.007 | 0.0037 | 0.110 | 0.012 | 0.080 | 0.28 | 0.10 |
| K | 0.050 | 0.20 | 1.85 | 0.010 | 0.002 | 0.0022 | 0.020 | 0.0041 | 0.073 | 0.013 | 0.050 | 0.29 | 0.01 |
| L | 0.044 | 0.19 | 1.78 | 0.011 | 0.002 | 0.0022 | 0.028 | 0.0054 | 0.101 | 0.018 | 0.01 | 0.23 | 0.22 |
| M | 0.049 | 0.15 | 1.75 | 0.007 | 0.001 | 0.0016 | 0.020 | 0.0035 | 0.075 | 0.011 | 0.040 | 0.10 | 0.20 |
| N | 0.054 | 0.22 | 1.80 | 0.009 | 0.002 | 0.0016 | 0.018 | 0.0044 | 0.081 | 0.014 | 0.100 | 0.01 | 0.25 |
| O | 0.055 | 0.07 | 1.79 | 0.008 | 0.001 | 0.0020 | 0.007 | 0.0038 | 0.058 | 0.012 | 0.01 | 0.30 | 0.01 |
| P | 0.058 | 0.25 | 1.79 | 0.002 | 0.002 | 0.0023 | 0.048 | 0.0036 | 0.053 | 0.012 | 0.077 | 0.24 | 0.21 |

TABLE 2-continued

| | | | | | | | | | | | | | |
|---|---|---|---|---|---|---|---|---|---|---|---|---|---|
| Q | 0.061 | 0.24 | 1.70 | 0.002 | 0.002 | 0.0021 | 0.020 | 0.0060 | 0.056 | 0.018 | 0.070 | 0.00 | 0.00 |
| R | 0.060 | 0.35 | 1.21 | 0.021 | 0.002 | 0.0024 | 0.023 | 0.0020 | 0.081 | 0.006 | 0.100 | 0.25 | 0.25 |

| | Chemical composition (unit: mass%) | | | | | | | | |
|---|---|---|---|---|---|---|---|---|---|
| Steel | Cu | Ni | V + Mo + Cr | Cu + Ni | Ca | N** | Nb-93/14xN* | Others | Remarks |
| A | 0.19 | 0.27 | 0.32 | 0.46 | 0.0011 | 0.0003 | 0.0750 | | Inv. ex. |
| B | 0.20 | 0.28 | 0.34 | 0.48 | 0.0012 | 0.0003 | 0.0730 | | Comp.ex. |
| C | 0.20 | 0.26 | 0.32 | 0.46 | 0.0011 | 0.0004 | 0.0733 | | Comp.ex. |
| D | 0.18 | 0.29 | 0.30 | 0.47 | 0.0011 | 0.0001 | 0.0763 | | Comp.ex. |
| E | 0.16 | 0.15 | 0.20 | 0.31 | 0.0008 | 0.0002 | 0.0377 | | Comp.ex. |
| F | 0.25 | 0.24 | 0.54 | 0.49 | 0.0009 | 0.0002 | 0.0547 | REM: 0.0020% | Inv. ex. |
| G | 0.23 | 0.22 | 0.43 | 0.45 | 0.0010 | 0.0002 | 0.0996 | | Inv. ex. |
| H | 0.11 | 0.13 | 0.25 | 0.24 | 0.0022 | −0.0028 | 0.0698 | | Comp.ex. |
| I | 0.09 | 0.10 | 0.24 | 0.19 | 0.0010 | 0.0029 | 0.0486 | | Comp.ex. |
| J | 0.28 | 0.25 | 0.46 | 0.53 | 0.0010 | 0.0002 | 0.1087 | | Comp.ex. |
| K | 0.18 | 0.26 | 0.34 | 0.44 | 0.0021 | 0.0003 | 0.0710 | | Inv. ex. |
| L | 0.00 | 0.29 | 0.45 | 0.29 | 0.0026 | 0.0002 | 0.1000 | B: 0.0008% | Inv. ex. |
| M | 0.20 | 0.50 | 0.34 | 0.70 | 0.0009 | 0.0003 | 0.0730 | | Comp.ex. |
| N | 0.25 | 0.13 | 0.35 | 0.38 | 0.0010 | 0.0003 | 0.0789 | | Inv. ex. |
| O | 0.25 | 0.25 | 0.30 | 0.50 | 0.0009 | 0.0003 | 0.0560 | | Inv. ex. |
| P | 0.25 | 0.25 | 0.53 | 0.50 | 0.0000 | 0.0001 | 0.0523 | | Comp.ex. |
| Q | 0.00 | 0.00 | 0.07 | 0.00 | 0.0011 | 0.0008 | 0.0510 | | Comp.ex. |
| R | 0.24 | 0.25 | 0.60 | 0.49 | 0.0009 | 0.0003 | 0.0793 | | Inv. ex. |

Details of the production conditions are shown in Table 3. Here, "composition" indicates the symbols of the slabs shown in Table 2, "light rolling" indicates the existence of any light rolling operation at the time of final solidification in continuous casting, "heating temperature" indicates the actual slab heating temperature, "solubilization temperature" indicates the temperature calculated by $$SRT(^\circ C.)=6670/(2.26-\log([\%\ Nb]\times[\%\ C]))-273$$

"holding time" indicates the holding time at the actual slab heating temperature, "cooling between passes" indicates the existence of any cooling between rolling stands performed for the purpose of shortening the temperature waiting time occurring before non-recrystallization temperature range rolling, "non-recrystallization region total reduction rate" indicates the total reduction rate of rolling performed in the recrystallization temperature range, "FT" indicates the final rolling end temperature, the "Ar3 transformation point temperature" indicates the calculated Ar3 transformation point temperature, the "cooling rate to 650° C." indicates the average cooling rate when passing through a temperature range of the cooling start temperature to 650° C., and "CT" indicates the coiling temperature.

TABLE 3

| | Production conditions | | | | | | | | | | | | | | | | |
|---|---|---|---|---|---|---|---|---|---|---|---|---|---|---|---|---|---|
| | | | | | | Reduction rates of passes in recrystallization region (%) | | | | | | | | | | | |
| Steel No. | Composition | Light rolling | Heating temperature (° C.) | Solubilizing temperature (° C.) | Holding time (min) | 1 | 2 | 3 | 4 | 5 | 6 | 7 | 8 | 9 | 10 | 11 | Cooling between passes |
| 1 | A | Yes | 1180 | 1140 | 30 | 15 | 12 | 13 | 13 | 13 | 14 | 20 | 22 | — | — | — | Yes |
| 2 | A | No | 1080 | 1140 | 30 | 15 | 12 | 13 | 13 | 13 | 14 | 20 | 22 | — | — | — | No |
| 3 | A | No | 1280 | 1140 | 30 | 15 | 12 | 13 | 13 | 13 | 14 | 20 | 22 | — | — | — | No |
| 4 | A | No | 1180 | 1140 | 5 | 15 | 12 | 13 | 13 | 13 | 14 | 20 | 22 | — | — | — | Yes |
| 5 | A | Yes | 1180 | 1140 | 30 | 15 | 12 | 9 | 10 | 10 | 12 | 12 | 12 | 16 | 13 | — | No |
| 6 | A | No | 1180 | 1140 | 30 | 15 | 10 | 11 | 11 | 10 | 11 | 11 | 13 | 27 | — | — | No |
| 7 | A | No | 1180 | 1140 | 30 | 15 | 12 | 13 | 13 | 13 | 14 | 20 | 22 | 18 | 18 | — | No |
| 8 | A | No | 1180 | 1140 | 30 | 15 | 12 | 13 | 13 | 13 | — | — | — | — | — | — | No |
| 9 | A | No | 1180 | 1140 | 30 | 15 | 12 | 13 | 13 | 13 | 14 | 20 | 22 | — | — | — | No |
| 10 | A | Yes | 1180 | 1140 | 30 | 15 | 12 | 13 | 13 | 13 | 14 | 20 | 22 | — | — | — | Yes |
| 11 | A | No | 1180 | 1140 | 30 | 15 | 12 | 13 | 13 | 13 | 14 | 20 | 22 | — | — | — | Yes |
| 12 | B | No | 1170 | 1139 | 20 | 15 | 12 | 13 | 13 | 13 | 14 | 20 | 22 | 16 | 13 | — | Yes |
| 13 | C | No | 1170 | 1144 | 20 | 15 | 12 | 13 | 13 | 13 | 14 | 20 | 22 | 16 | 13 | — | No |
| 14 | D | No | 1170 | 1140 | 20 | 15 | 12 | 9 | 10 | 10 | 12 | 12 | 12 | — | — | — | No |
| 15 | E | No | 1170 | 1111 | 20 | 15 | 12 | 13 | 13 | 13 | 14 | 20 | 22 | — | — | — | No |
| 16 | F | No | 1170 | 1134 | 20 | 15 | 12 | 13 | 13 | 13 | 14 | 20 | 22 | — | — | — | Yes |
| 17 | G | No | 1230 | 1119 | 20 | 15 | 12 | 13 | 13 | 13 | 14 | 20 | 22 | — | — | — | Yes |
| 18 | H | No | 1200 | 1136 | 30 | 15 | 12 | 13 | 13 | 13 | 14 | 20 | 22 | 16 | 13 | — | No |
| 19 | I | No | 1200 | 1177 | 30 | 15 | 12 | 13 | 13 | 13 | 14 | 20 | 22 | — | — | — | No |
| 20 | J | No | 1200 | 1057 | 30 | 15 | 12 | 13 | 13 | 13 | 14 | 20 | 22 | — | — | — | No |
| 21 | K | Yes | 1200 | 1147 | 30 | 15 | 12 | 13 | 13 | 13 | 14 | 20 | 22 | — | — | — | No |
| 22 | L | No | 1200 | 1173 | 30 | 23 | 14 | 15 | 16 | 17 | 20 | 19 | — | — | — | — | No |
| 23 | M | No | 1200 | 1148 | 30 | 15 | 12 | 13 | 13 | 13 | 14 | 20 | 22 | — | — | — | No |
| 24 | N | No | 1200 | 1171 | 30 | 15 | 12 | 13 | 13 | 13 | 14 | 20 | 22 | 16 | 13 | — | No |
| 25 | O | No | 1200 | 1129 | 30 | 15 | 12 | 13 | 13 | 13 | 14 | 20 | 22 | 16 | 13 | — | No |
| 26 | P | No | 1200 | 1125 | 30 | 15 | 12 | 13 | 13 | 13 | 14 | 20 | 22 | 16 | 13 | — | No |

TABLE 3-continued

| | | | | | | | | | | | | | | | | | |
|---|---|---|---|---|---|---|---|---|---|---|---|---|---|---|---|---|---|
| 27 | Q | No | 1200 | 1138 | 30 | 15 | 12 | 13 | 13 | 13 | 14 | 20 | 22 | 16 | 13 | — | No |
| 28 | R | No | 1200 | 1185 | 30 | 15 | 12 | 13 | 13 | 13 | 14 | 20 | 22 | 16 | 13 | — | No |

| | Production conditions | | | | | |
|---|---|---|---|---|---|---|
| Steel No. | Non-recrystallization region total reduction rate (%) | FT (° C.) | Ar3 transformation point temperature (° C./sec) | Cooling rate (° C./sec) | CT (° C.) | Remarks |
| 1 | 75 | 850 | 665 | 10 | 600 | Inv. ex. |
| 2 | 75 | 850 | 665 | 10 | 600 | Comp.ex. |
| 3 | 75 | 850 | 665 | 10 | 600 | Comp.ex. |
| 4 | 75 | 850 | 665 | 10 | 600 | Comp.ex. |
| 5 | 75 | 850 | 665 | 11 | 600 | Inv. ex. |
| 6 | 75 | 850 | 665 | 15 | 600 | Inv. ex. |
| 7 | 62 | 850 | 665 | 10 | 600 | Comp.ex. |
| 8 | 86 | 850 | 665 | 17 | 600 | Comp.ex. |
| 9 | 75 | 660 | 665 | 10 | 600 | Comp.ex. |
| 10 | 75 | 850 | 665 | 1 | 600 | Comp.ex. |
| 11 | 75 | 850 | 665 | 10 | 450 | Comp.ex. |
| 12 | 75 | 830 | 665 | 15 | 570 | Comp.ex. |
| 13 | 75 | 830 | 665 | 15 | 570 | Comp.ex. |
| 14 | 82 | 830 | 667 | 15 | 570 | Comp.ex. |
| 15 | 75 | 830 | 695 | 15 | 570 | Comp.ex. |
| 16 | 75 | 830 | 663 | 25 | 570 | Inv. ex. |
| 17 | 75 | 850 | 652 | 12 | 600 | Inv. ex. |
| 18 | 75 | 850 | 715 | 13 | 600 | Comp.ex. |
| 19 | 75 | 850 | 703 | 10 | 600 | Comp.ex. |
| 20 | 0 | 970 | 639 | 10 | 600 | Comp.ex. |
| 21 | 75 | 850 | 661 | 10 | 600 | Inv. ex. |
| 22 | 75 | 850 | 646 | 5 | 600 | Inv. ex. |
| 23 | 80 | 850 | 655 | 5 | 600 | Comp.ex. |
| 24 | 75 | 830 | 581 | 30 | 600 | Inv. ex. |
| 25 | 75 | 830 | 587 | 30 | 600 | Inv. ex. |
| 26 | 75 | 830 | 583 | 30 | 600 | Comp.ex. |
| 27 | 75 | 830 | 652 | 30 | 600 | Comp.ex. |
| 28 | 75 | 830 | 603 | 30 | 600 | Inv. ex. |

The grade of the steel sheet obtained in this way is shown in Table 4. The methods of examination were as shown below. The microstructure was examined by cutting out a test piece from a position of ¼W or ¾W of the sheet width (W) from an end of the steel sheet in the width direction, polishing the cross-section in the rolling direction, using a Nital reagent to etch it, then obtaining a photo of a field at 1/25 of the sheet thickness observed using an optical microscope at a power of 200 to 500×. Further, the "average circle equivalent diameter of the precipitates containing Ti nitrides" is defined as that obtained by observing the same sample as the above at a part at 1/45 of the sheet thickness (t) from the steel sheet surface using an optical microscope at a power of 1000×, obtaining values from photographs of the microstructure of at least 20 fields by an image processor etc., and taking the average value of the same.

Further, the ratio of the complex oxides containing Ca, Ti, and Al forming the nuclei of the precipitates containing Ti nitrides is defined as the ratio of the precipitates containing Ti nitrides observed in the above micrographs which contain such nuclei-forming complex oxides, that is, (number of precipitates containing Ti nitrides containing nuclei-forming complex oxides)/(total number of precipitates containing Ti nitrides observed). Furthermore, the composition of the nuclei-forming complex oxides was identified by analysis of at least one oxide in each field and was confirmed by an energy dispersive X-ray spectroscope (EDS) or electron energy loss spectroscope (EELS) attached to a scan type electron microscope.

The tensile test was conducted by cutting out a No. 5 test piece described in JIS Z 2201 from the C direction and following the method of JIS Z 2241. The Charpy impact test was conducted by cutting out a test piece described in JIS Z 2202 from the C direction at the center of sheet thickness and following the method of JIS Z 2242. The DWTT (drop weight tear test) was conducted by cutting out a test piece of a strip shape of 300 mmL×75 mmW×thickness (t) mm in the C direction and pressing it to give it a 5 mm notch. The HIC test was conducted based on NACETM0284.

In Table 4, the "microstructure" is the microstructure of the part at ½t of the sheet thickness from the surface of the steel sheet. "Zw" is the continuously cooled transformed structure and is defined as a microstructure including one or more of $\alpha^{\circ}_{B}$, $\alpha_B$, $\alpha_q$, $\gamma_r$, and MA. "PF" indicates polygonal ferrite, "worked F" indicates worked ferrite, "P" indicates pearlite, and the "$\alpha_B+\alpha_q$ fraction" indicates the total area fraction of granular bainitic ferrite ($\alpha_B$) and quasi-polygonal ferrite ($\alpha_q$).

The "precipitation strengthening particle size" shows the size of the precipitates containing Nb effective for precipitation strengthening as measured by the 3D atom probe method. The "precipitation strengthening particle density" shows the density of the precipitates containing Nb effective for precipitation strengthening as measured by the 3D atom probe method. The "average circle equivalent diameter" shows the average circle equivalent diameter of precipitates containing Ti nitrides measured by the above method. The "content ratio" shows the number ratio of the above precipitates containing Ti nitrides which include complex oxides forming nuclei. The "composition of complex oxides" show the results of analysis by EELS, indicated as "G" (good) when the elements are detected and as "P" (poor) when not. The results of the "tensile test" show the results of C-direction JIS No. 5 test pieces. "$FATT_{85\%}$" shows the test temperature giving a ductile fracture rate of 85% in a DWTT test. The "absorbed energy $vE_{-20°\ C.}$" shows the absorbed energy obtained in a Charpy impact test at −20° C. The "fracture unit" shows the average value of the fracture units obtained by measurement of fractures for five or more fields by SEM at a power of about 100×. Further, the "strength-vE balance" is expressed as the product of "TS" and the "absorbed energy $vE_{-20°\ C.}$". Furthermore, "CAR" shows the area ratio of cracks found by the HIC test.

TABLE 4

| | Microstructure | | | | Precipitates containing Ti nitrides | | | | | Mechanical properties Tensile test | | |
|---|---|---|---|---|---|---|---|---|---|---|---|---|
| | | | | | Average | | Composition of complex oxides | | | | | |
| Steel No. | Micro-structure | $\alpha_B + \alpha_q$ fraction (%) | Precipitation strengthening particle size (nm) | Precipitation strengthening particle density (/m³) | circle equivalent diameter (μm) | Content (%) | Ca | Al | Ti | YP (MPa) | TS (MPa) | EI (%) |
| 1 | Zw | 85 | 1.5 | $10 \times 10^{22}$ | 2 | 60 | o | o | o | 578 | 708 | 32 |
| 2 | Zw | 55 | 5.0 | $1 \times 10^{18}$ | 2 | 60 | o | o | o | 520 | 644 | 36 |
| 3 | Zw | 15 | 1.8 | $5 \times 10^{22}$ | 2 | 60 | o | o | o | 590 | 721 | 31 |
| 4 | Zw | 50 | 4.5 | $1 \times 10^{19}$ | 2 | 60 | o | o | o | 550 | 670 | 34 |
| 5 | Zw | 90 | 2.0 | $4 \times 10^{22}$ | 2 | 60 | o | o | o | 583 | 711 | 32 |
| 6 | Zw | 80 | 2.2 | $3 \times 10^{22}$ | 2 | 60 | o | o | o | 571 | 699 | 33 |
| 7 | Zw | 20 | 1.3 | $20 \times 10^{22}$ | 2 | 60 | o | o | o | 592 | 722 | 32 |
| 8 | PF + Zw | — | 7.0 | $5 \times 10^{17}$ | 2 | 60 | o | o | o | 550 | 674 | 33 |
| 9 | Worked F + P | — | 6.0 | $3 \times 10^{17}$ | 2 | 60 | o | o | o | 566 | 693 | 24 |
| 10 | PF + P | — | 30.0 | $4 \times 10^{22}$ | 2 | 60 | o | o | o | 548 | 671 | 34 |
| 11 | Zw | 60 | 0.8 | $50 \times 10^{20}$ | 2 | 60 | o | o | o | 481 | 636 | 36 |
| 12 | Zw | 55 | 1.5 | $15 \times 10^{22}$ | 6 | 25 | o | o | o | 582 | 710 | 32 |
| 13 | Zw | 60 | 1.3 | $20 \times 10^{22}$ | 6 | 25 | o | o | o | 588 | 715 | 32 |
| 14 | Zw | 55 | 1.3 | $10 \times 10^{22}$ | 6 | 35 | o | o | x | 581 | 707 | 33 |
| 15 | Zw + P | — | 3.0 | $3 \times 10^{22}$ | 2.5 | 60 | o | o | o | 530 | 644 | 36 |
| 16 | Zw | 75 | 1.2 | $5 \times 10^{22}$ | 2 | 65 | o | o | o | 612 | 745 | 31 |
| 17 | Zw | 90 | 1.0 | $30 \times 10^{22}$ | 2.5 | 50 | o | o | o | 604 | 736 | 31 |
| 18 | Zw + P | — | 2.5 | $5 \times 10^{22}$ | 2 | 50 | o | o | o | 574 | 701 | 33 |
| 19 | Zw + P | — | 1.5 | $10 \times 10^{22}$ | 2 | 55 | o | o | o | 581 | 716 | 32 |
| 20 | PF | — | — | — | 1 | 50 | o | o | o | 520 | 641 | 36 |
| 21 | Zw | 65 | 1.5 | $4 \times 10^{22}$ | 3 | 90 | o | o | o | 564 | 710 | 33 |
| 22 | Zw | 55 | 2.0 | $15 \times 10^{22}$ | 3 | 55 | o | o | o | 580 | 692 | 33 |
| 23 | Zw | 50 | 2.5 | $5 \times 10^{22}$ | 5 | 25 | x | o | x | 595 | 722 | 32 |
| 24 | Zw | 70 | 1.5 | $10 \times 10^{22}$ | 2 | 65 | o | o | o | 590 | 713 | 32 |
| 25 | Zw | 85 | 1.1 | $5 \times 10^{22}$ | 2 | 65 | o | o | o | 567 | 691 | 33 |
| 26 | Zw | 70 | 1.2 | $5 \times 10^{22}$ | 5 | 85 | o | o | o | 609 | 736 | 31 |
| 27 | Zw | 55 | 1.8 | $5 \times 10^{22}$ | 6 | 25 | o | o | o | 598 | 611 | 33 |
| 28 | Zw | 65 | 1.3 | $5 \times 10^{22}$ | 2 | 65 | o | o | o | 593 | 725 | 32 |

| Mechanical properties Toughness evaluation test | | | | | |
|---|---|---|---|---|---|
| $FATT_{85\%}$ (° C.) | Absorbed energy ($vE_{-20°\ C.}$) (J) | Fracture unit (μm) | Strength-vE balance (MPa · J) | HIC CAR (%) | Remarks |
| −45 | 330 | 20 | 233640 | 0 | Inv. ex. |
| −40 | 260 | 22 | 167440 | 4 | Comp.ex. |
| −5 | 220 | 48 | 158620 | 6 | Comp.ex. |
| −45 | 250 | 20 | 167500 | 5 | Comp.ex. |
| −30 | 305 | 25 | 216855 | 0 | Inv. ex. |
| −25 | 285 | 28 | 199215 | 3 | Inv. ex. |
| 0 | 170 | 51 | 122740 | 3 | Comp.ex. |
| −5 | 155 | 18 | 104470 | 4 | Comp.ex. |
| −10 | 130 | 21 | 90090 | 5 | Comp.ex. |
| −35 | 240 | 25 | 161040 | 1 | Comp.ex. |
| −40 | 250 | 20 | 159000 | 5 | Comp.ex. |
| −5 | 255 | 60 | 181050 | 8 | Comp.ex. |
| −5 | 250 | 50 | 178750 | 4 | Comp.ex. |
| 0 | 245 | 55 | 173215 | 6 | Comp.ex. |
| −20 | 190 | 29 | 122360 | 9 | Comp.ex. |
| −35 | 270 | 24 | 201150 | 5 | Inv. ex. |
| −20 | 320 | 28 | 235520 | 5 | Inv. ex. |
| −15 | 150 | 45 | 105150 | 8 | Comp.ex. |
| −10 | 140 | 50 | 100240 | 5 | Comp.ex. |
| −40 | 250 | 22 | 160250 | 6 | Comp.ex. |
| −35 | 280 | 60 | 198800 | 0 | Inv. ex. |
| −40 | 310 | 85 | 214520 | 4 | Inv. ex. |

TABLE 4-continued

| | | | | | |
|---|---|---|---|---|---|
| 0 | 150 | 55 | 108300 | 5 | Comp.ex. |
| −20 | 265 | 28 | 188945 | 6 | Inv. ex. |
| −35 | 310 | 23 | 214210 | 7 | Inv. ex. |
| −5 | 220 | 48 | 161920 | 9 | Comp.ex. |
| −10 | 210 | 51 | 128310 | 9 | Comp.ex. |
| −30 | 270 | 24 | 195750 | 4 | Inv. ex. |

PF: polygonal ferrite,
P: pearlite ,
$\alpha_B + \alpha_q$: granular bainitic ferrite ($\alpha_B$) and quasi-polygonal ferrite ($\alpha_q$)

The steels satisfying the requirements of the present invention are the 10 steels of the Steel Nos. 1, 5, 6, 16, 17, 21, 22, 24, 25, and 28. These give high strength hot rolled steel sheets for line pipe use excellent in ductile fracture arrest performance having tensile strengths corresponding to the X80 grade as materials before pipemaking characterized by containing predetermined amounts of steel ingredients, having microstructures of continuously cooled transformed structures in which precipitates containing Nb of average sizes of 1 to 3 nm are dispersed at an average density of 3 to $30\times10^{22}/m^3$, furthermore having average circle equivalent diameters of precipitates containing Ti nitrides contained in steel sheet with an $\alpha_B$ and/or $\alpha_q$ of a volume fraction of 50% or more of 0.1 to 3 μm, and, furthermore, having at least half of these in number contain complex oxides including Ca, Ti, and Al. Furthermore, Steel Nos. 1, 5, and 21 performed light rolling, so achieved CAR indicators of the sour resistance of the targeted 3% or less.

The other steels are outside the scope of the present invention for the following reasons. Steel No. 2 has a heating temperature outside the scope of the present claim 4, so the average size of the precipitates containing Nb (precipitation strengthening particle size) and average density (precipitation strengthening particle density) are outside the scope of claim 1 and a sufficient effect of precipitation strengthening cannot be obtained, so the strength-vE balance is low.

Steel No. 3 has a heating temperature outside the scope of the present claim 4, so the prior austenite grains coarsen, the desirable continuously cooled transformed structure cannot be obtained after transformation, and the $FATT_{85\%}$ is a high temperature.

Steel No. 4 has a heating holding time outside the scope of the present claim 4, so a sufficient precipitation strengthening effect cannot be obtained, so the strength-vE balance is low.

Steel No. 7 has a total reduction rate of the non-recrystallization temperature range outside the scope of the present claim 4, so the prior austenite grains coarsen, the desirable continuously cooled transformed structure cannot be obtained after transformation, and the $FATT_{85\%}$ is a high temperature.

Steel No. 8 has a total reduction rate of the recrystallization region outside the scope of the present claim 4, so the targeted microstructure etc. described in claim 1 cannot be obtained, and the strength-vE balance is low.

Steel No. 9 has a final rolling temperature outside the scope of the present claim 4, so the targeted microstructure etc. described in claim 1 cannot be obtained, and the strength-vE balance is low.

Steel No. 10 has a cooling rate outside the scope of the present claim 4, so the target microstructure described in claim 1 cannot be obtained, and the strength-vE balance is low.

Steel No. 11 has a CT outside the scope of the present claim 4, so a sufficient precipitation strengthening effect cannot be obtained, so the strength-vE balance is low.

Steel No. 12 has a time in the smelting process until charging Al after Ti deoxidation outside the scope of the present claim 4, so the dispersion of the oxides forming the nuclei of the precipitates containing the Ti nitrides is insufficient, so the targeted nitride size described in claim 1 becomes over 3 μm and the $FATT_{85\%}$ is a high temperature.

Steel No. 13 has an amount of dissolved oxygen before charging of Ti and an equilibrium amount of dissolved oxygen in the smelting process outside the scope of the present claim 4, so the targeted nitride size described in claim 1 becomes over 3 μm and the $FATT_{85\%}$ is a high temperature.

Steel No. 14 has an order of charging of successive deoxidizing elements in the smelting process outside the scope of the present claim 4, so the targeted nitride size described in claim 1 becomes over 3 μm and the $FATT_{85\%}$ is a high temperature.

Steel No. 15 has a content of C etc. which is outside the scope of the present claim 1, so the targeted microstructure is not obtained, and the strength-vE balance is low.

Steel No. 18 has a content of C etc. which is outside the scope of the present claim 1, so the targeted microstructure is not obtained, and the strength-vE balance is low.

Steel No. 19 has a content of C etc. which is outside the scope of the present claim 1, so the targeted microstructure is not obtained, and the strength-vE balance is low.

Steel No. 20 has a content of C etc. which is outside the scope of the present claim 1, so the targeted microstructure is not obtained, and the strength is low.

Steel No. 23 has an order of charging of successive deoxidizing elements in the smelting process outside the scope of the present claim 4, so the targeted nitride size described in claim 1 becomes over 3 μm and the $FATT_{85\%}$ is a high temperature.

Steel No. 26 has a Ca content outside the scope of the present claim 1, so the targeted nitride size described in claim 1 becomes over 3 μm and the $FATT_{85\%}$ is a high temperature.

Steel No. 27 has V, Mo, Cr and Cu, and Ni contents outside the scope of the present claim 1, so as a material, a tensile strength corresponding to the X80 grade cannot be obtained.

INDUSTRIAL APPLICABILITY

By using the hot rolled steel sheet of the present invention for electric resistance welded steel pipe and spiral steel pipe, production of line pipe with a high strength of the API5L-X80 standard or more can be produced even with a relatively large sheet thickness of for example half an inch (12.7 mm) even in artic regions where tough fracture resistance is demanded. Furthermore, due to the method of production of the present invention, the hot rolled steel sheet for electric resistance welded steel pipe and spiral steel pipe use can be stably produced inexpensively in large amounts. Therefore, the present invention enables line pipe to be laid easier under harsh conditions. We are confident that it will greatly contribute to the construction of pipelines—which is key to the global distribution of energy.

The invention claimed is:

1. A method of production of a high strength hot rolled steel sheet for line pipe use excellent in low temperature toughness and ductile fracture arrest performance, the hot rolled steel sheet containing alloy ingredient elements, by mass %, C=0.02 to 0.06%, Si=0.05 to 0.5%, Mn=1 to 2%,

P≤0.03%,

S≤0.005%,

O=0.0005 to 0.003%,

Al=0.005 to 0.03%,

N=0.0015 to 0.006%,

Nb=0.05 to 0.12%,

Ti=0.005 to 0.02%,

Ca=0.0005 to 0.003%,

N-14/48xTi≥0%, and

Nb-93/14x(N-14/48xTi)>0.05%, further containing

O<V≤0.3%,

O<Mo≤0.3%, and

O<Cr≤0.3%, where 0.2%≤V+Mo+Cr≤0.65%, further containing

O<Cu≤0.3% and

O<Ni≤0.3%, where 0.1%≤Cu+Ni≤0.5%, and having a balance of Fe and unavoidable impurities, the method comprising:

preparing a molten steel to give a concentration of Si of 0.05 to 0.2% and a concentration of dissolved oxygen of 0.002 to 0.008%, adding to the molten steel Ti in a range giving a content of 0.005 to 0.3% for deoxidation, then adding Al within 5 minutes to give a content of 0.005 to 0.02%, then adding Ca to give a content of 0.0005 to 0.003%, then adding the alloy ingredient elements to give a content falling within the ranges for the hot rolled steel sheet and to cause solidification, cooling a resultant cast slab, heating said cast slab to a temperature range of an SRT (° C.) calculated by formula (1) to 1260° C., wherein $$SRT(^\circ C.)=6670/(2.26-\log([\%\ Nb]\times[\%\ C]))-273 \quad (1)$$

wherein [% Nb] and [% C] show the contents (mass %) of Nb and C in the cast slab, further holding the slab at said temperature range for 20 minutes or more, then hot rolling at a total reduction rate of a non-recrystallization temperature range of 65% to 85%, ending the rolling in a temperature range of 830° C. to 870° C., then cooling in a temperature range down to 650° C. at a cooling rate of 2° C./sec to 50° C./sec, and coiling at 500° C. to 650° C.

2. The method of production as set forth in claim 1, characterized by cooling before rolling in said non-recrystallization temperature range.

3. The method of production as set forth in claim 1, characterized by continuously casting said cast slab, wherein the cast slab is lightly rolled while controlling the amount of reduction so as to match solidification shrinkage at a final solidification position of the cast slab.

4. The method of production as set forth in claim 1, wherein the hot rolled steel sheet further contains, by mass %, B=0.0002 to 0.003%.

5. The method of production as set forth in claim 1, wherein the hot rolled steel sheet further contains, by mass %, REM=0.0005 to 0.02%.

* * * * *